US006358028B1

(12) United States Patent
Abe et al.

(10) Patent No.: US 6,358,028 B1
(45) Date of Patent: Mar. 19, 2002

(54) SCROLL COMPRESSOR

(75) Inventors: Nobuo Abe; Hidenari Takada; Koichi Sekiguchi, all of Shimotsuga-gun; Toshio Yamanaka, Yokohama; Shoichi Nakashima, Hitachi, all of (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 09/418,489

(22) Filed: Oct. 15, 1999

(30) Foreign Application Priority Data

Oct. 15, 1998 (JP) ..... 10-293293

(51) Int. Cl.[7] ..... F03C 2/00
(52) U.S. Cl. ..... 418/55.3; 418/55.2; 418/179
(58) Field of Search ..... 418/55.3, 55.2, 418/179

(56) References Cited

U.S. PATENT DOCUMENTS

| | | | | |
|---|---|---|---|---|
| 5,127,809 A | * 7/1992 | Amata et al. | ..... | 418/55.5 |
| 5,263,822 A | * 11/1993 | Fujio | ..... | 418/55.5 |
| 5,275,543 A | * 1/1994 | Tanaka et al. | ..... | 418/55.3 |
| 5,382,144 A | * 1/1995 | Tanaka et al. | ..... | 418/55.3 |
| 5,919,034 A | * 7/1999 | Kawano et al. | ..... | 418/55.3 |
| 5,931,651 A | * 8/1999 | Kawano et al. | ..... | 418/55.3 |

FOREIGN PATENT DOCUMENTS

| | | | | |
|---|---|---|---|---|
| JP | 62-298680 | * 12/1987 | ..... | 418/55.3 |
| JP | 02-283882 | * 11/1990 | ..... | 418/55.3 |
| JP | 04-179885 | * 6/1992 | ..... | 418/55.3 |
| JP | 04-330391 | * 11/1992 | ..... | 418/55.3 |
| JP | 04-330392 | * 11/1992 | ..... | 418/55.3 |
| JP | 05-231348 | * 9/1993 | ..... | 418/55.3 |
| JP | 07-097990 | * 4/1995 | ..... | 418/55.5 |
| JP | 63-134882 | * 4/1995 | ..... | 418/55.3 |
| JP | 1082382 | 3/1998 | | |
| JP | 10082382 | 3/1998 | | |

OTHER PUBLICATIONS

Hydraulics & Pneumatics, 1994, vol. 33, No. 6, pp. 39–44.

* cited by examiner

*Primary Examiner*—Thomas Denion
*Assistant Examiner*—Theresa Trieu
(74) *Attorney, Agent, or Firm*—Antonelli, Terry, Stout & Kraus, LLP

(57) ABSTRACT

A scroll compressor, in which as a coolant is applied a mixture coolant obtained by mixing at least one or more kinds selected from a group of hydro fluoro carbon, within a closed container thereof, comprising: an electricmotor; a rotary scroll driven with said electric motor; and a stationary scroll, whereby forming a scroll compression mechanism between said rotary scroll for compressing said coolant, wherein said scroll compression mechanism comprises: Oldham ring for supporting said rotary scroll so that said rotary scroll perform a gyrating movement with respect to said stationary scroll without spinning around an axis thereof; and a frame for supporting said Oldham ring in movable manner for purpose of achieving supporting of said rotary scroll mentioned above, wherein said Oldham ring is formed from sintered alloy of iron group, while said frame and said rotary scroll are formed from cast iron, and after treating a steam process thereon, a sliding surface of said Oldham ring is machined by means of an end mill.

5 Claims, 3 Drawing Sheets

SCROLL COMPRESSOR

BACKGROUND OF THE INVENTION

1. Field of the Invention

The present invention relates to a scroll compressor, which is mainly used in a refrigerating apparatus as well as in an air conditioning apparatus, for business use and also for home use.

2. Description of Prior Art

Conventionally, as a compressor for use in the refrigerating apparatus and air conditioning apparatus, there are already known various types, such as of a reciprocating type compressor, a rotary type compressor, etc., and they are applied to separately, depending upon the respective properties, such as a cost, performances, etc. Among of those, in particular, the scroll type compressor has been achieving a great growth or success due to the properties thereof, such as high efficiency, low noise, low vibration, etc.

With the compression mechanism applied into such the scroll type compressor, in which a fixed or stationary scroll and a rotary scroll are toothed with, each having a wing or fin in a form of a vortex curve, thereby forming a several number of compressing chambers between them, wherein those chambers are reduced in the volumes thereof with shifting or moving from a peripheral portion side communicated to a suction inlet for sucking coolant to an internal periphery communicated to a discharge outlet due to a rotating movement of the rotary scroll, thereby to discharge the compressed coolant from the discharge outlet.

The rotary scroll mentioned above is supported with the Oldham ring, not spinning around it's axis but for performing gyrating movement, and this Oldham ring is supported by a frame so that it can be shifted for achieving the purpose of the support above-mentioned. Accordingly, the Oldham ring can be shifted or moved between both the frame and the rotary scroll.

In general, the scroll compressor is manufactured by forming the rotary scroll, the stationary scroll and the frame, each being made of cast iron, however the Oldham ring is formed from sintered alloy of iron group. This is because the Oldham ring and the rotary scroll are brought under the most severe sliding condition, therefore they are formed with a respective combination of different kinds of metals, each. Namely, the cast iron contains has high wear and abrasion resistance, inherently, because it contains graphite therein, while the sintered alloy of iron group contains a lot of holes or vacancies therein, therefore is inferior in the property of wear and abrasion resistance.

By the way, as the coolant has was used a specific flon R12 or a specific flon R22. Those specific flons, each being stable chemically comparing to sulfur disulfide or methylchroride which was used before, as well as be flammable, and nonpoisonous, therefore they were used widely as an ideal coolant, and for a long time.

However, in recent years, it is ascertained that those specific flons containing chlorine atoms in the molecular thereof causes destruction of the ozone layer, therefore an alternative flon is developed to be used in place thereof.

As the alternative flon having high practicability, there is listed up a coolant, such as HFC (Hydro Fluoro Carbon) containing no chlorine atom therein, for example in "Oil/Air Pressure Technology ('94.6)" (issued by Japan Industry Publication, Co., Ltd.).

However, when using the alternative coolant, since it contains no chlorine atom therein, the coolant cannot be expected to show sufficient lubricant property therewith. Because of this, the sliding condition comes to be severe, and in particular, in a case where the rotary scroll and the frame, both being made of cast iron as mentioned above, are combined with the Oldham ring made of sintered alloy of iron group, directly, on a bare surface thereof as it is, abrasion can be easily caused at the sliding portion, therefore, there is a possibility that the life time of the supporting structure portion is reduced or shorten.

This is, because the sliding portions between the Oldham ring and both the rotary scroll and the frame in the supporting mechanism mentioned above is easily brought into a condition where a portion of the lubricant film on the boundary thereof is dried up or broken due to the low lubricant property of the coolant (hereinafter, "a boundary lubrication condition), therefore adhesion can easily occurs due to the fact that both the portions or structures being lubricated on the boundary are made of the similar materials of the iron group, i.e., the cast iron and the sintered alloy of iron group.

In this manner, the reduction of the life time of the Oldham ring and the rotary scroll comes up to be a problem, especially in a case of a compressor of the closed-type, which is generally of maintenance free and is kept driven for a long life time, since the life time of the compressor as a whole is directly determined by the life time of the above-mentioned supporting mechanism portion, therefore there is a possibility that it cannot be applied to or endure with actual practice or use thereof.

Then, as an example of measure for dealing with such the abrasion on the supporting mechanism portion which is provided with that Oldham ring and with the rotary scroll and the frame, there is known a technology shown in Japanese Patent Laying-open No. Hei 10-82382 (1998).

This conventional technology is shown in FIG. 5, wherein a reference numeral 6 depicts or illustrates the Oldham ring, which is formed from the sintered alloy of iron group. A reference numeral 17 indicates a projection, which is provided for supporting the rotary scroll, not spinning around the axis thereof by itself. A reference numeral 22 indicates a steam processed layer, i.e., it is formed by conducting a steam process or a nitride gas softening process thereon, after machining the sliding surface on the projection 17. With the provision of the steam processed layer 22 which is formed, there can be obtained a change in quality on the sliding surface of the projection 17 into the property other than that of the metal, as well as the increase in hardness thereof, thereby improving the durability or resistance against wear and abrasion under the condition of the boundary lubrication.

However, with the conventional art shown by the Japanese Patent Laying-Open No. Hei 10-82382 (1998), since it is a socalled chemical process which is applied thereon, it is impossible to control or manage the thickness of the processed film layer of the projections with high accuracy, therefore there is still a possibility that a trouble occurs sometimes when the Oldhum ring is assembled with the rotary scroll and the frame, in particular, in insertion thereof into gutters or drains of the rotary scroll and the frame to be assembled with.

An object of the present invention, therefore, is to provided a scroll compressor having no such the problem, i.e., no such the reduction or shortening in the life time due to the supporting mechanism portion of the rotary scroll, with use of the alternative coolant which contains no chlorine therein, as well as to dissolve such the problem as mentioned in the above in the assembling thereof, caused due to the accuracy of the parts thereof, thereby obtaining the scroll type compressor having high efficiency in the manufacturing thereof.

SUMMARY OF THE INVENTION

The above-mentioned object, according to the present invention, is accomplished by a scroll compressor, into which as a coolant is applied a mixture coolant obtained by mixing at least one or more kinds selected from a group of hydro fluoro carbon, within a closed container thereof, comprising:

an electric motor;

a rotary scroll driven with said electric motor; and a stationary scroll, whereby forming a scroll compression mechanism between said rotary scroll for compressing said coolant, wherein said scroll compression mechanism comprises:

Oldham ring for supporting said rotary scroll so that said rotary scroll perform a gyrating movement with respect to said stationary scroll without spinning around an axis thereof; and a frame for supporting said Oldham ring in movable manner for purpose of achieving supporting of said rotary scroll mentioned above, wherein said Oldham ring is formed from sintered alloy of iron group, while said frame and said rotary scroll are formed from cast iron, and after treating a steam process thereon, a sliding surface of said Oldham ring is machined.

Further, according to the present invention, there is also provide the scroll compressor as defined in the above, wherein a projecting surface of said Oldham ring treated with the steam process is machined by means of an end mill.

DETAILED DESCRIPTION OF PREFERRED EMBODIMENT(S)

Figure 1:
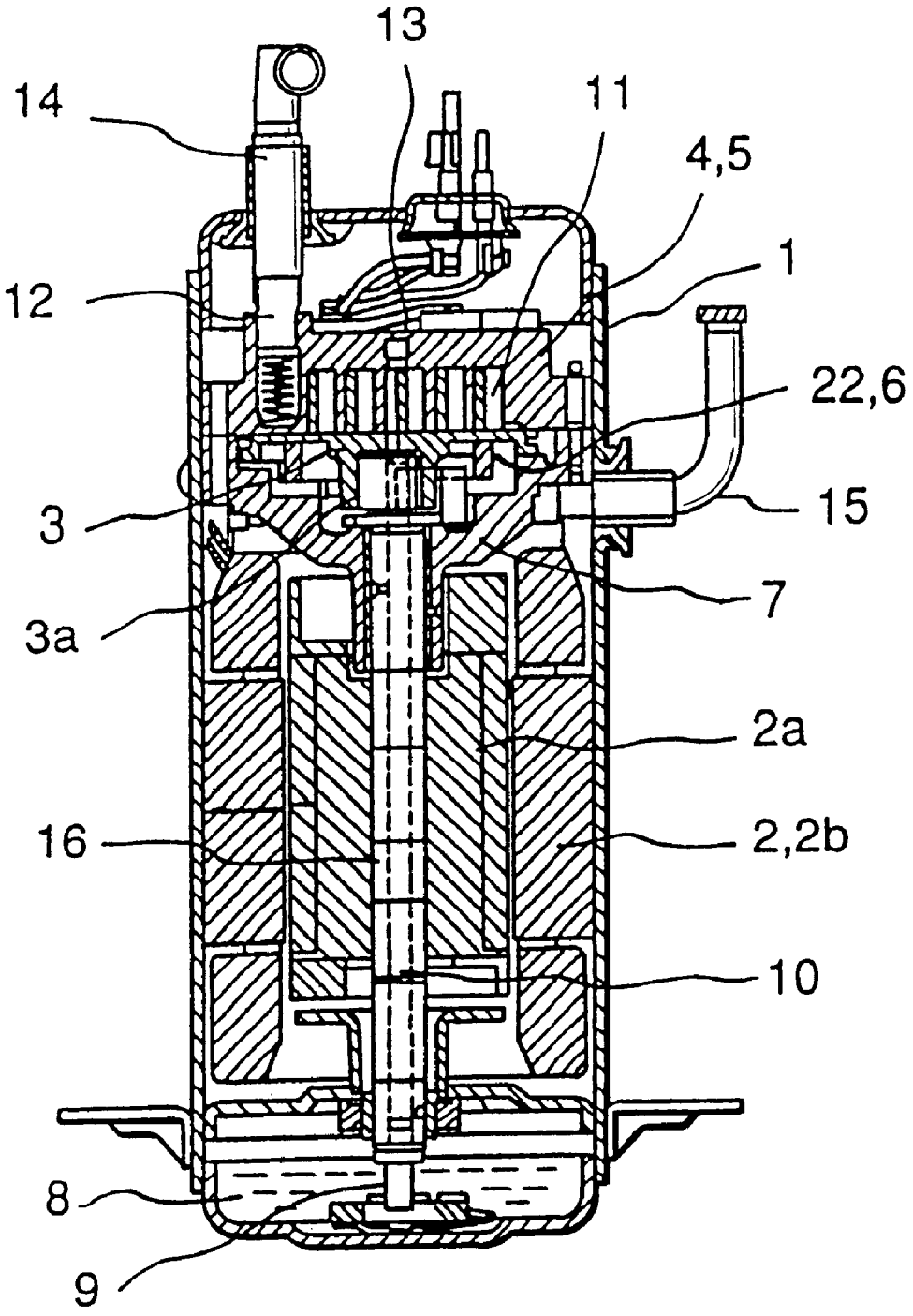
FIG. 1 is a cross section view of a vertical type scroll compressor for showing an embodiment of the present invention.

Hereinafter, embodiments according to the present invention will be fully explained by referring to the attached drawings. In FIG. 1, there is shown an example of the construction of a vertical type scroll compressor for use in a refrigerating apparatus and/or an air conditioning apparatus. In this compressor, a mixture coolant is used, being obtained by mixing one or two kinds or more than that, selected among those of the coolants of a fluorohydrocarbon (or hydro fluoro carbon) group, and within a closed container 1 are provided an electric motor 2, a rotary scroll 3 driven with the electric motor 2, a fixed or stationary scroll 4, and a compression mechanism 5 for compressing the above coolant between them. And, the sliding surface of the Oldham ring 6, for supporting the rotary scroll 3 with respect to the stationary scroll 4, not spinning around the axis by itself, but performing the gyrating movement therewith, is formed with a surface being different in the kind from both the sliding surfaces of the frame for movably supporting that Oldham ring 6 for the purpose of such the support as mentioned above and the rotary scroll 3.

Since the scroll compressor shown in the FIG. 1 is of so-called a vertical type, there are enclosed or sealed the compressor mechanism 5 in an upper portion of the closed container, while the electric motor 2 in a lower portion thereof, and lubricant oil 8 in the lowest or bottom portion thereof. Also, there is provide an oil supply piece 9 for supplying the lubricant oil 8 up to a portion(s) to be lubricated, through an oil bore penetrating through within an inside of a crank shaft 16. The compressor mechanism 5 is constructed by toothing or meshing the stationary scroll 4 as an upper side and the rotary scroll 3 at a lower side, in a manner similar to the conventional art, wherein the rotary scroll 3 is ratably driven with the revolution of the electric motor 2 through the above-mentioned Oldham ring 6.

With this gyrating movement or drive, a several number of compressing chambers 11 which are formed between the rotary scroll 3 and the stationary scroll 4 are reduced in the volumes thereof while they are shifted or moved from an outer periphery side communicated to a suction inlet 12 to an inter periphery side communicated to a discharge outlet 13, thereby performing the compression. The coolant is sucked from a suction pipe or tube 14 extending outside the closed container 1 into the suction inlet 12. While, the coolant compressed is discharged from the discharge outlet 13 within the closed container 1, and after being supplied from a discharge pipe or tube 15 extending outside the closed container 1 to a refrigerating or cooling cycle (not shown in the figure) for use in an air conditioning, for instance, it is turned back to the above-mentioned suction tube 14, thereby achieving the circulating thereof. By performing or conducting a series of the operations or functions mentioned above with continuity, the refrigerating cycle is constructed or performed.

The frame 7 is fixed within the closed container 1 so that it can keep or maintain a condition that the rotary scroll 3 is toothed or meshed between the stationary scroll 4, to each other, and it has a bearing at a center portion thereof so as to be connected to a rotor 2*a* of the electric motor 2 at a lower portion thereof, while it maintains or supports the crank shaft 16 which is clamped to the bearing 3*a* with an decentering or eccentric portion 16*a* at the upper portion thereof. Around the rotor 2*a* is provided a stator 2*b*, thereby constructing the electric motor 2.

Figure 2:
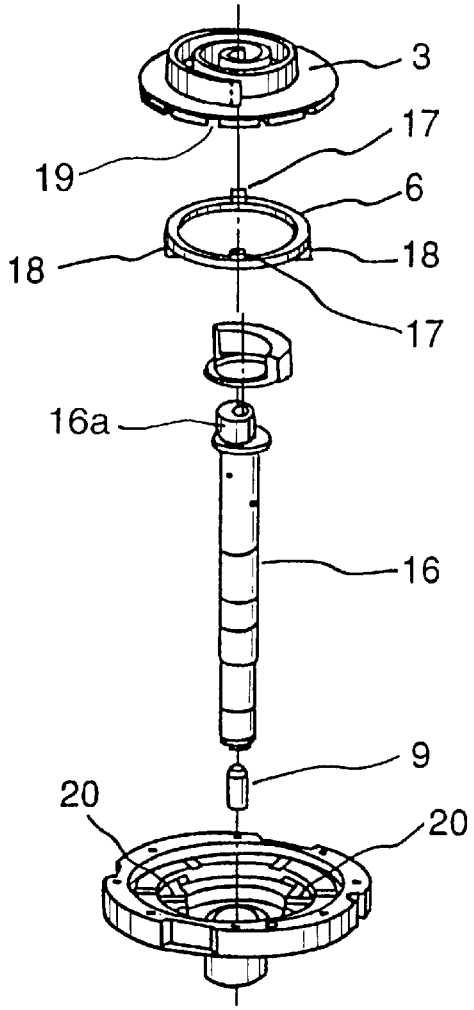
FIG. 2 is a perspective explosion view for showing an essential portion(s) of the compressor shown in the FIG. 1.

On the Oldham ring 6, as shown in FIG. 2, there are provided projections 17 at two (2) locations, along a line of a diameter on a side surface opposing the rotary scroll 3, as well as, with projections 18 at two (2) locations along a line of the diameter on other side surface opposing the frame 7, respectively, wherein the both are aligned in the directions being orthogonal to each other.

The projections 17 of the Oldham ring 6 are inserted into radial direction grooves 19 which are formed at the two (2) locations along a line of the diameter of the rotary scroll 3, so as to support it in movable manner in the direction of aligning the projections 17, while the projections 18 are inserted into radial direction grooves 20 at the two (2) locations along a line of the diameter of the frame 7 so that the Oldham ring 6 can move in the direction of aligning the projections 18. With this, the rotary scroll 3 is supported, not spinning around it's axis but enabling to perform the gyrating movement. Thereby, when the crank shaft 16 is rotated, the rotary scroll 3, not being spin around it's axis, but is driven to gyrate.

Figure 3:
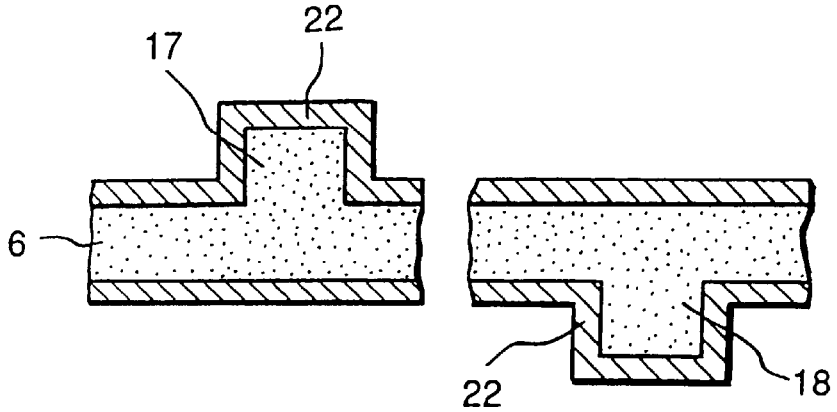
FIG. 3 is a cross section view for showing the condition of a steam process on the Oldham ring shown in the FIG. 2.
Figure 4:
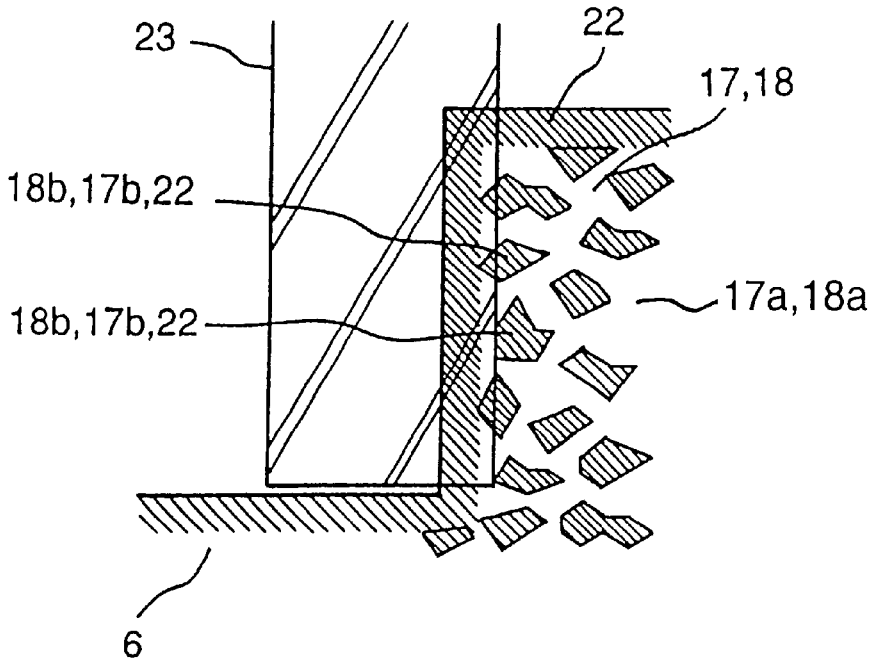
FIG. 4 is a cross section view for schematically showing the condition in machining a projection on the Oldham ring shown in the FIG. 3, and the condition in forming the steam processed layer on the surface of the projection.
Figure 5:
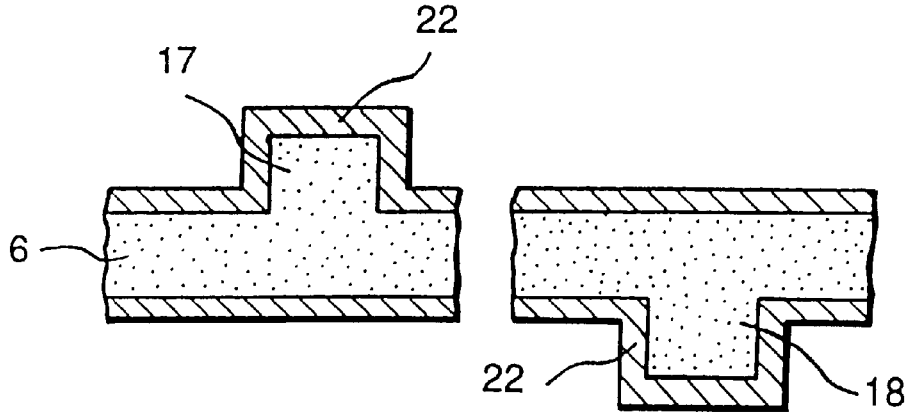
FIG. 5 is a cross section view for showing an example of a method for improving the surface of the Oldham ring in quality thereof, according to the conventional art.

The coolant being applied into the refrigerating cycle, in which the above-mentioned scroll type compressor is installed, is the mixture coolant, being obtained by mixing at least one or two kinds or more than that, being selected among those of the coolants of the fluorohydrocarbon (or HFC) group, however it does not contain chlorine, thereby bringing about no such the destruction of environment. However, the coolant discharged within the closed container 1, though it can reach to details of each mechanical sliding portions, however the lubrication cannot be expected to be performed therewith since it contains no chlorine therein, therefore, there is a possibility that the boundary lubrication condition occurs on both the sliding surfaces of the rotary scroll 3 and the frame 7, between the Oldham ring 6. However, as shown in FIG. 3, between the Oldham ring 6 and both the rotary scroll 3 and the frame 7, by treating a steam process on the Oldham ring 6 and by machining the most upper surface of the projections 17 and 18, the projections 17 and 18 can be formed with high accuracy, in particular in the size of width thereof, thereby enabling to obtain the appropriate insertion thereof into the grooves 19 and 20, and further as shown in FIG. 4, because of the presence of a steam processed layer 22 (oxidized film layer), being harder than the foundations 17*a* and 18*a* of the sintered material of iron group, exposing upon the surface of the projections 17 and 18, formed with holes or vacancies 17*b* and 18*b* therein peculiar to the sintered metal, the durability or resistance against wear and abrasion can be improved, thereby enabling to escape from the adhesion under the boundary lubrication conditions. With this, the life time of the supporting structure portion with use of the Oldham ring 6 of the rotary scroll 3 can be improved, therefore dissolving such the problem, i.e., the decrease or shorten in the life time due to the supporting structure portion, even when applying the alternative coolant containing no chlorine therein.

In the present embodiment, the projections 17 and 18 of the Oldham ring 6 receives the sliding from both the rotary scroll 3 and the frame 7, therefore, for the purpose of forming the steam processed layer 22 having a different kind of property on the surface thereof, the steam process is treated on the materiel of the Oldham ring 6 as a whole, as shown in the FIG. 3. After forming the steam processed layer 22, as shown in the FIG. 4, on the most upper surface is treated with a machining, such as cutting or grinding by means of such as an end mill 23 (not shown in the figures), thereby making the surface of the projections into a texture or structure in which the steam processed layer 22 is deposed and mixed between the foundations 17*a* and 18*a* and the holes or vacancies 17*b* and 18*b*. According to the present invention, since the improvement of the surface of the Oldham ring 6 in the quality thereof can be achieved by means of the steam process which can be treated easily in relative, there can be obtained an advantage that it can be met with use of the existing parts of the Oldham ring 6 made of sintered alloy of iron group, being the same kind of the rotary scroll 3 and the frame 7 of cast iron. The steam process of the Oldham ring 6 is conducted for 1 hour or longer than that, for example, with steam at temperature of 500–600° C. The steam processed layer 22 obtained in this manner is increased in the hardness thereof due to the property of oxidized film layer, thereby enabling to prevent the adhesion of the mechanical sliding portions on the rotary scroll 3 and the frame due to the poor lubrication thereof.

According to the present invention, by treating the steam process on the material of the Oldham ring made of sintered alloy of iron group, and further machining the most upper surface thereof so as to form the projections to be inserted into the gutters of the rotary scroll and the frame, in the width size with the high accuracy, as well as exposing the steam process layer on the surface of the projections, which is higher in the hardness than the foundation formed containing holes or vacancies therein, no adhesion will not be caused even when the boundary lubrication condition occurs between the sliding portions of the Oldham ring and both the rotary scroll and the frame of cast iron. As the result of this, it is possible to obtain a long life time of the closed type compressor for use in the refrigerating and air conditioning apparatuses with maintenance free.

While we have shown and described several embodiments in accordance with out invention, it should be understood that disclosed embodiments are susceptible of changes and modifications without departing from the scope of the invention. Therefore, we do not intend to be bound by the details shown and described herein but intent to cover all such changes and modifications falling within the ambit of the appended claims.

What is claimed is:

1. A scroll compressor comprising:

a closed container;

a stationary scroll provided in the closed container;

a rotary scroll provided in the closed container and meshed with the stationary scroll;

a fixed frame within the closed container to maintain a meshed condition between the stationary scroll and the rotary scroll; and an Oldham ring contacting the rotary scroll and the frame to control a rotation of the rotary scroll, the Oldham ring having at least one sliding surface comprising a foundation of sintered alloy of iron group and parts of oxide comprising iron oxide.

2. The scroll compressor according to claim 1, wherein the at least one sliding surface is provided on a projection of the Oldham ring.

3. The scroll compressor according to claim 2, the at least one sliding surface of the Oldham ring contacts a groove provided on the rotary scroll or the frame.

4. The scroll compressor according to claim 1, wherein the parts of oxide comprising iron oxide on the at least one sliding surface of the Oldham ring are provided in holes of the foundation of sintered alloy of iron group of the Oldham ring.

5. A scroll compressor, comprising:

a closed container;

a stationary scroll provided in the closed container;

a rotary scroll provided in the closed container and meshed with the stationary scroll;

a fixed frame within the closed container to maintain a meshed condition between the stationary scroll and the rotary scroll; and an Oldham ring contacting the rotary scroll and the frame to control a rotation of the rotary scroll, the Oldham ring having at least one sliding surface comprising a foundation of sintered alloy of iron group and parts of oxide comprising iron oxide, wherein the parts of oxide comprising iron oxide on the at least one sliding surface of the Oldham ring are provided in holes of the foundation of sintered allow of iron group of the Oldham ring, and wherein at least one surface is provided by subjecting the foundation to a steam process to form an oxide layer comprising iron oxide and machining the at least one sliding surface to expose the foundation having the parts of oxide comprising iron oxide provided in the holes in the foundation.

* * * * *